US007338322B2

(12) United States Patent
Ju

(10) Patent No.: US 7,338,322 B2
(45) Date of Patent: Mar. 4, 2008

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/399,374

(22) Filed: Apr. 7, 2006

(65) Prior Publication Data

US 2007/0238329 A1 Oct. 11, 2007

(51) Int. Cl.
*H01R 13/648* (2006.01)

(52) U.S. Cl. ..... 439/609; 439/607

(58) Field of Classification Search ..... 439/609, 439/607, 608, 610

See application file for complete search history.

(56) References Cited

U.S. PATENT DOCUMENTS 4,813,890 A * 3/1989 Zell et al. ..... 439/607
6,056,600 A * 5/2000 Watanabe et al. ..... 439/607
6,074,223 A * 6/2000 Huang ..... 439/95
6,109,967 A * 8/2000 Chiou ..... 439/607
6,319,061 B1 * 11/2001 Chen et al. ..... 439/607
6,676,449 B2 * 1/2004 Ji et al. ..... 439/607
6,716,064 B2 * 4/2004 Kubo ..... 439/607
6,997,748 B1 * 2/2006 Su ..... 439/607
2001/0003077 A1 * 6/2001 Van Woensel ..... 439/701
2003/0157836 A1 * 8/2003 Morikawa et al. ..... 439/607
2003/0199197 A1 * 10/2003 Yu et al. ..... 439/607
2004/0180577 A1 * 9/2004 Zhang ..... 439/607
2005/0026501 A1 * 2/2005 Zhan et al. ..... 439/607
2005/0277334 A1 * 12/2005 Huang ..... 439/607
2006/0121782 A1 * 6/2006 Shen et al. ..... 439/607

* cited by examiner

*Primary Examiner*—Gary Paumen
(74) *Attorney, Agent, or Firm*—Troxell Law Office, PLLC

(57) ABSTRACT

An electrical connector is disclosed, comprising an insulating main body provided with a plurality of through spaces; at least an electrical terminal accommodated in the insulating main body; and a metal housing covering the insulating main body and having a plurality of stamped elastic pieces which are provided on at least one side of the metal housing close to the insulating main body and can pass through the through spaces, such that the electrical connector whose metal housing is provided with a plurality of stamped elastic pieces can not only effectively secure the insulating main body but also provide good electrical contact and butt connection between the electrical connector and electronic components without the need of additional securing devices.

16 Claims, 6 Drawing Sheets

ELECTRICAL CONNECTOR

FIELD OF THE INVENTION

The present invention relates to an electrical connector and particularly to an electrical connector with a metal housing which can effectively secure the insulating main body accommodated therein and strengthen fastening for the electronic components connected to the electrical connector.

BACKGROUND OF THE INVENTION

An electrical connector, especially the electrical connector used in high frequency communication, usually uses a metal housing to secure the insulating main body in the electrical connector. Consequently, the metal housing can shield the insulating main body and a plurality of electrical terminals accommodated in the insulating main body so as to reduce the effects of external electromagnetic interference (EMI) on the signals transmitted in the electrical connector.

Conventional electrical connector used in high frequency communication is usually provided with a metal housing, which covers one side and is not completely closed; consequently, the insulating main body cannot be securely fastened in the electrical connector. Moreover, when electronic components are butt connected to the electrical connector, additional fastening devices are usually required to provide good electrical conduction, leading to high cost and tedious operation.

Accordingly, it is necessary to design an electrical connector with a metal housing which can effectively secure the insulating main body accommodated therein and strengthen fastening for the electronic components connected to the electrical connector in order to overcome the drawback described above.

SUMMARY OF THE INVENTION

An object of the present invention is to provide an electrical connector which can effectively secure the insulating main body accommodated therein and strengthen fastening for the electronic components connected to the electrical connector.

In order to accomplish the objects of the present invention described above, an electrical connector according to the present invention, comprising an insulating main body provided with a plurality of through spaces; at least an electrical terminal accommodated in the insulating main body; and a metal housing covering the insulating main body and having a plurality of stamped elastic pieces which are provided on at least one side of the metal housing close to the insulating main body and can pass through the through spaces.

Compared with conventional prior arts, an electrical connector according to the present invention has the following advantages: the metal housing is provided with a plurality of stamped elastic pieces can effectively secure the insulating main body accommodated therein and strengthen fastening for the electronic components butt connected to the electrical connector even without additional fastening devices.

BRIEF DESCRIPTION OF THE DRAWINGS

The present invention can be more fully understood by reference to the following description and accompanying drawings, in which.

DETAILED DESCRIPTION OF THE INVENTION

Figure 1:
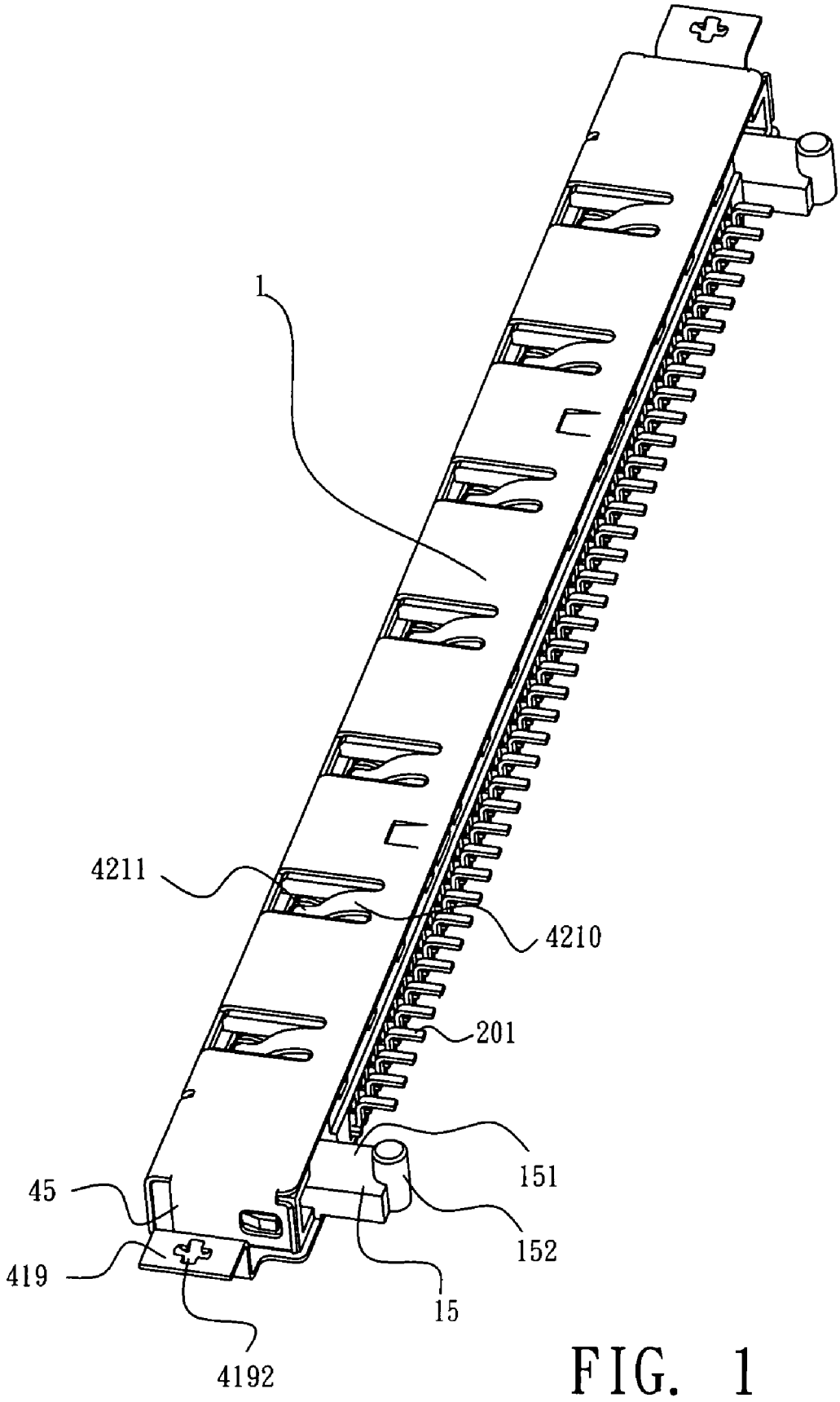
FIG. 1 is a schematically perspective view of a preferred embodiment of the electrical connector according to the present invention.
Figure 2:
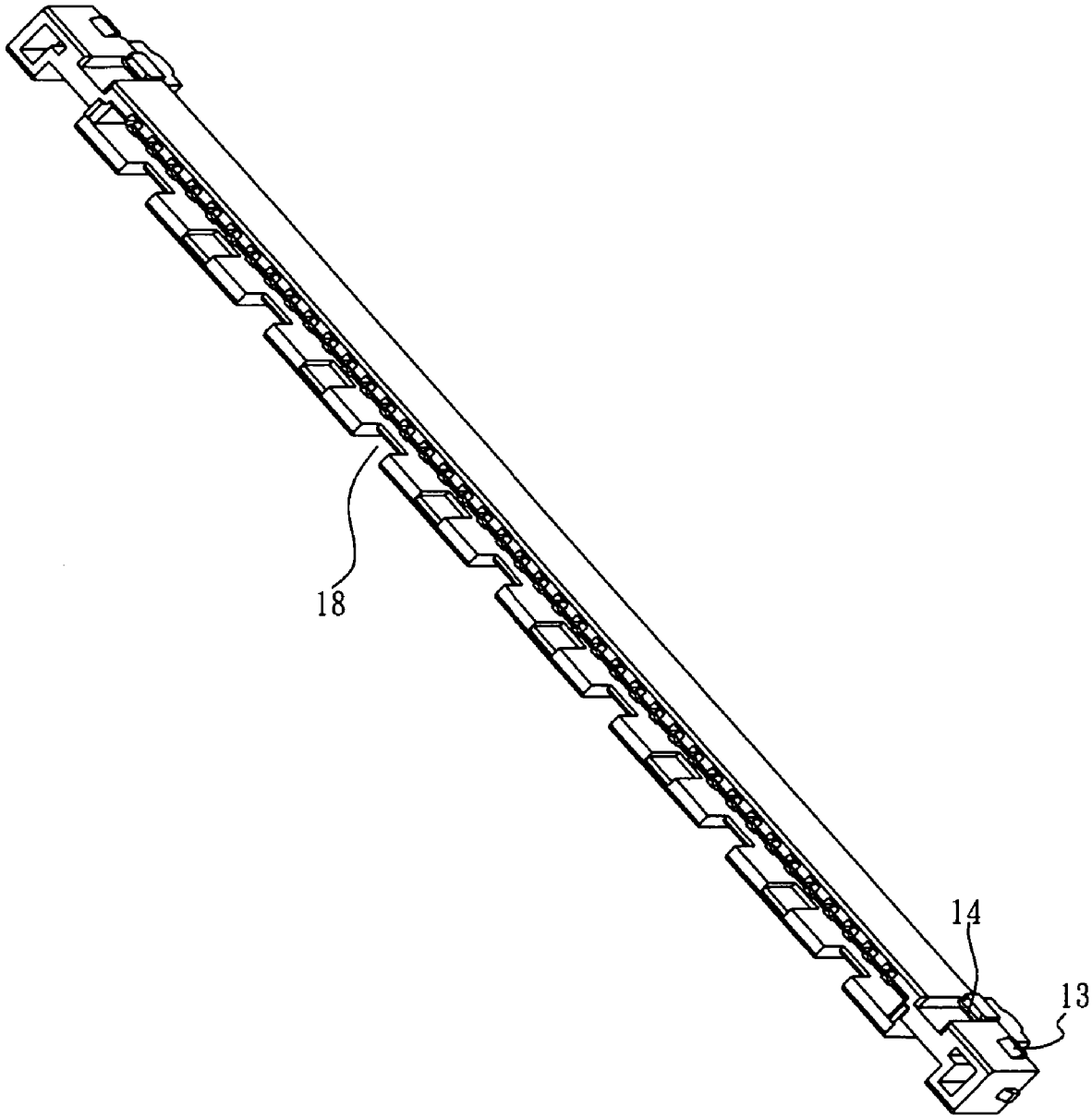
FIG. 2 is a schematically perspective view of the electrical connector in FIG. 1 from another angle of view.
Figure 3:
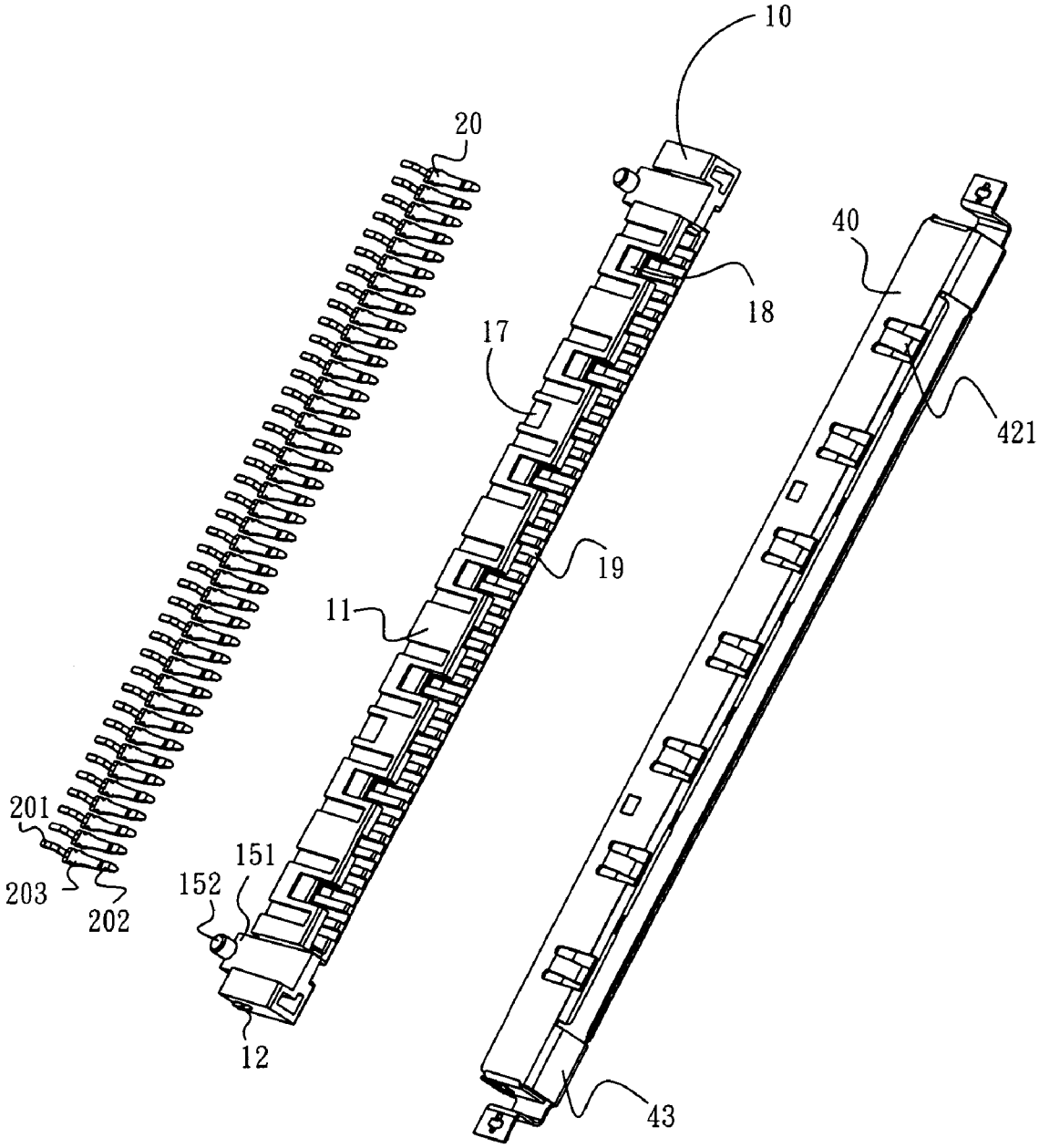
FIG. 3 is a schematically exploded perspective view of the electrical connector according to the present invention.
Figure 4:
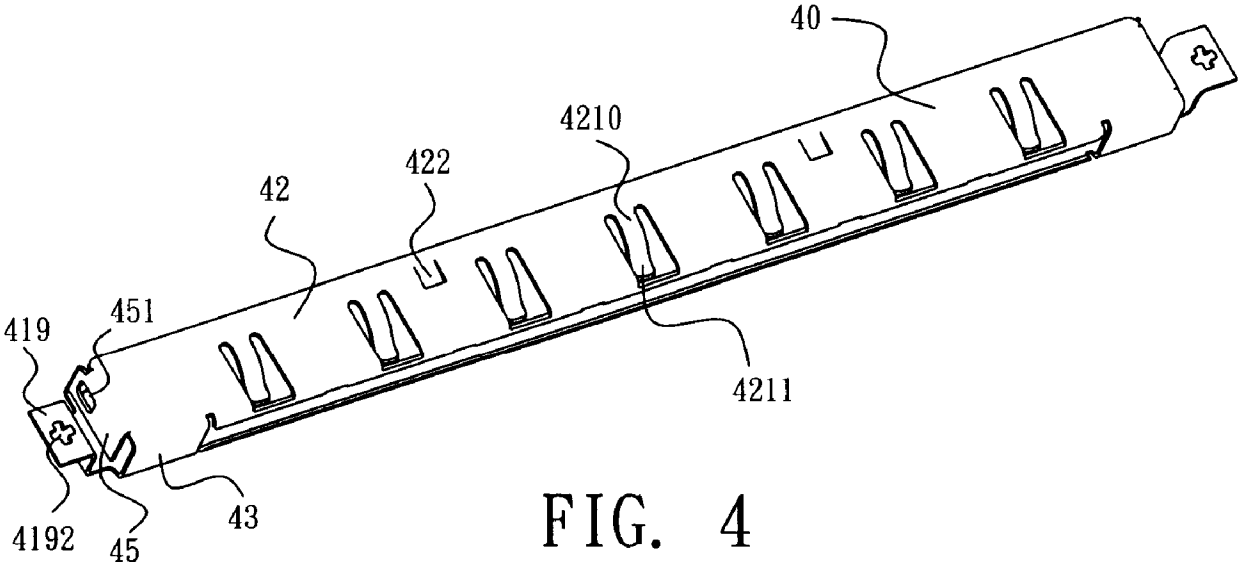
FIG. 4 is a schematically perspective view of the metal housing of the electrical connector according to the present invention.
Figure 5:
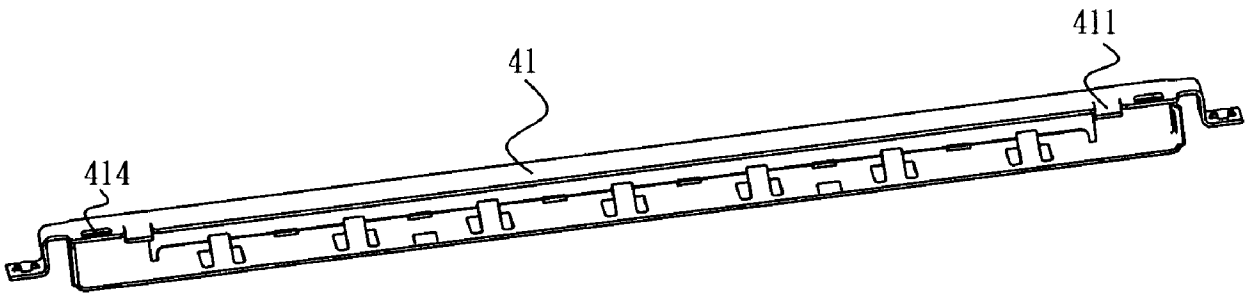
FIG. 5 is a schematically perspective view of the metal housing in FIG. 4 from another angle of view.
Figure 6:
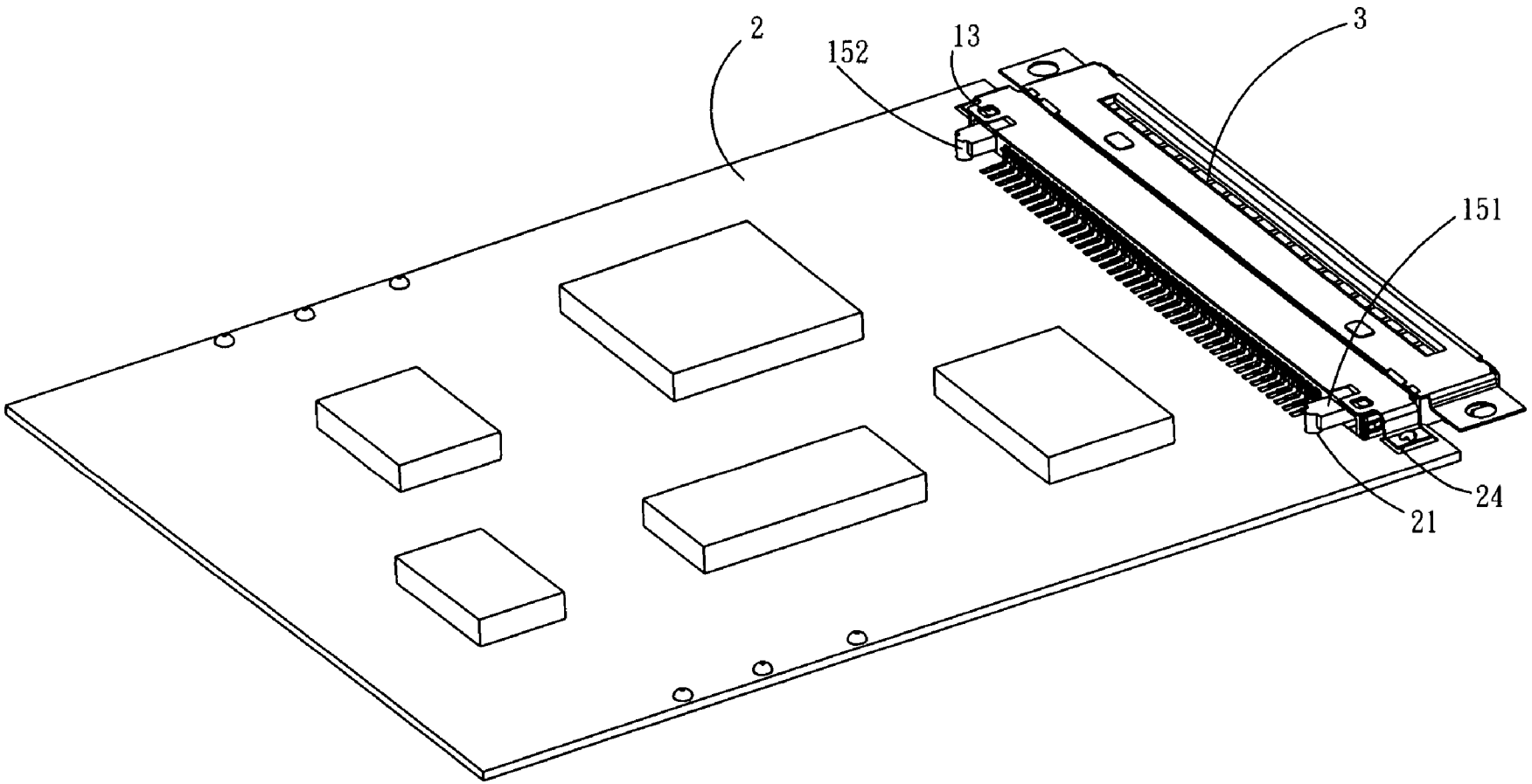
FIG. 6 is a schematically perspective view of the application of the electrical connector in the butt connection of electronic card and terminal connector according to the present invention.
Figure 7:
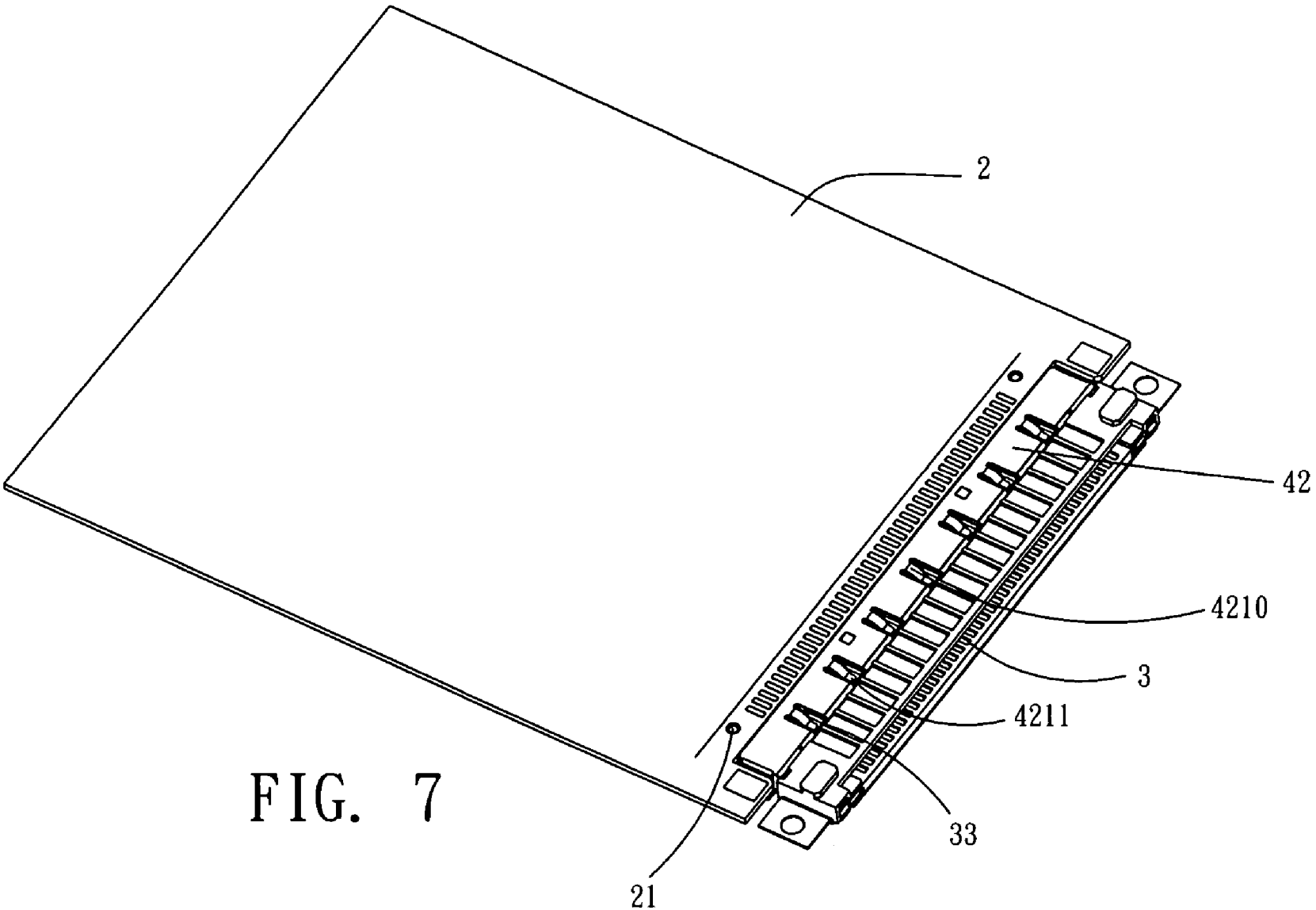
FIG. 7 is a schematically perspective view of FIG. 6 from another angle of view according to the present invention.

Referring to the FIGS. 1 to 7, an electrical connector according to the present invention comprises an insulating main body 10; a plurality of electrical terminals 20 accommodated in the insulating main body 10; and a metal housing 40 secured exteriorly of the insulating main body 10.

Wherein, the insulating main body 10 comprises a longitudinal main body 11; a first identical protrusion 12 is protrudingly provided with on the right and left sides of the main body 11, respectively; a second identical protrusion 13 is protrudingly provided on the both ends of the top of the main body 11, respectively; and a retaining recess 14 provided on the inner side of the two second protrusion 13, respectively.

The respective ends of the base portion 11 extend forwards to form a locating frame 15, which further comprises a base portion body 151 and a semi-cylinder locating rod 152 provided on the front end of the base portion body 151. The lower end of the locating rod 152 protrudes from the lower side of the base portion body 151 to engage with a locating hole 21 on a base portion plate 2 (an electronic card in the present embodiment, but of course it can be other electronic components) which is provided for receiving the electrical connector 1 so as to provide fastening and locating.

The lower side of the main body 11 is further provided with a plurality of through spaces 18 (through slots in the present embodiment), whose opposite sides are provided with two accommodating recesses 17 extending towards the base portion body 11, and the base portion body 11 is provided with a plurality of terminal accommodating recesses 19 to accommodate the terminals 20.

The electrical terminal 20 further comprises a soldering portion 201, a securing portion 203, and pressing portion 203, wherein the soldering portion 201 protrudes out of the insulating main body to butt connect with the base portion plate 2, the soldering portion 203 fastens and secures the electrical terminal 20 into the terminal accommodating recess 19, and the pressing portion 202 is formed with resilience by extending and bending from the retaining portion 203 to contact with the electrical terminal (not shown) of the external electronic component 3 inserted to achieve electrical conduction.

The metal housing 40 further comprises a upper flat base portion 41 and a lower base portion 42 facing each other vertically and a side wall 45, wherein the side wall 45 is formed upwards by bending the end of the lower flat base portion 42 and a connection portion 43 is provided between the two base portions 41 and 42. The lower flat base portion 42 is further provided with a plurality of elastic pieces 421, which are formed by stamping and upwards extending the lower flat base portion 42. The elastic piece 421 comprises an elastic piece base portion 4210 and a contact portion 4211, wherein the elastic piece base portion 4210 can elastically support the insulating main body 10 and the contact portion 4211 can abut against the external electronic component 3 (a terminal connector in the present embodiment, but of course it can be other electronic components) inserted into the electrical connector 1 through the through slot 18 of the insulating main body 10.

Furthermore, the lower flat base portion 42 is further provided with two locating supporters 422 by stamping, which are engaged with the accommodating recess 17 to fasten and locate the insulating main body 10. The upper flat base portion 41 is provided with two L-shape fastening pawls 411, which are provided on either end of the upper flat base portion 41. The fastening pawls 411 are formed by bending and forwards extending the upper flat base portion 41 and the fastening pawls 41 can be inserted into the retaining recess 14 on the insulating main body 10 such that the insulating main body 10 can be secured in the metal housing 40 to restrict the movement of the insulating main body 10.

Moreover, the metal housing 40 further comprises a plurality of first locating holes 414 and second locating holes 451, wherein the lower flat base portion 41 is provided with two first locating holes 414, which are located on the far sides of the fastening pawls 411, respectively. The first locating holes 414 are engaged with the second protrusions 13 on the insulating main body 10 to provide fastening and locating. The two second locating holes 415 are located on the side wall 45, respectively, and are engaged with the first protrusions 12 on the insulating main body 10 to provide fastening and locating. The metal housing 40 is further provided with a retaining portion 419 formed by downwards bending, extending, and further bending the end of the upper flat base portion 41. The retaining portion 419 is further provided with a solder accommodating hole 4192 to accommodate solder (not shown). The retaining portion 419 can be engaged with the connection portion 24 on the base portion plate 2 to secure the electrical connector 1 onto the base portion plate 2.

Upon assembling, the insulating main body, which accommodates the electrical terminals 20, is first assembled into the metal housing 40 through engagements of the first locating hole 414 and the second protrusion 13, the second locating hole 451 and the first protrusion 12, the supporting portion 422 and the accommodating recess 17, and the fastening pawl 411 and the retaining recess 14, such that the insulating main body 10 can be securely fastened in the metal housing 40, and then the electrical connector 1 is electrically connected onto the base portion plate 2. When the a butt connecting portion 33 (a tongue-like shape with one side is provided with an electrical terminal accommodating recess which can accommodate an electrical terminal) of the external electronic component 3 is inserted into the electrical connector 1, the contact portion 4211 of the elastic piece 421 abuts upwards against the side without electrical terminals of the butt connecting portion 33 through the through slot 18, such that the side of the butt connection portion 33 with the electrical terminal accommodated presses upwards and tightly against the pressing portion 20 of the electrical terminal 20 of the electrical connector 1 to achieve electrical conduction. Consequently, when the external electronic component 3 is in butt connection with the electrical connector 1 according to the present invention, there is no need to provide additional securing devices, leading to cost down and convenient operation.

Consequently, with the use of the electrical connector according to the present invention, the metal housing is stamped to form a plurality of elastic pieces, which can not only effectively secure the insulating main body but also provide good electrical contact and butt connection between the electrical connector and electronic components without the need of additional securing devices. The electrical connector according to the present invention can indeed overcome the drawbacks of conventional electrical connectors described above.

While the invention has been described with reference to the a preferred embodiment thereof, it is to be understood that modifications or variations may be easily made without departing from the spirit of this invention, which is defined by the appended claims.

What is claimed is:

1. An electrical connector, comprising:

an insulating main body provided with a plurality of through spaces;

at least an electrical terminal accommodated in the insulating main body; and a metal housing covering the insulating main body and having a plurality of stamped elastic pieces which are provided on at least one side of the metal housing close to the insulating main body and pass through the through spaces, wherein the metal housing is further provided with a plurality of first locating holes and second locating holes, wherein the insulating main body is provided with a plurality of first protrusions and second protrusions corresponding to the first locating holes and the second locating holes and the first protrusions and second protrusions are accommodated into the first locating holes and the second locating holes, respectively.

2. The electrical connector according to claim 1, wherein each through space is a through slot.

3. The electrical connector according to claim 1, wherein each elastic piece further comprises a contact portion to abut against an external electronic component inserted therein.

4. The electrical connector according to claim 1; and wherein an edge of the metal housing is further provided with at least two fastening pawls to restrict the movement of the insulating main body.

5. The electrical connector according to claim 4, wherein the two fastening pawls are provided on either end of the upper flat base portion and are formed by bending and forwardly extending the metal housing.

6. The electrical connector according to claim 4, wherein the insulating main body is further provided with a retaining recesses to engage and locate the fastening pawls.

7. The electrical connector according to claim 1, wherein the metal housing further comprises a upper flat base portion and a lower flat base portion between which a connection portion is provided.

8. The electrical connector according to claim 1, wherein the respective end of the insulating main body is provided with a locating frame, which further comprises a base portion body and a locating rod provided on the front end of the base portion body.

9. The electrical connector according to claim 1, wherein the metal housing close to the insulating main body is stamped to form at least a locating supporter.

10. The electrical connector according to claim 9, wherein the insulating main body corresponding to the locating supporter is provided with an accommodating recess to accommodate and locate the locating supporter.

11. The electrical connector according to claim 1, wherein the metal housing is provided with a retaining portion which is formed by downwardly extending and then bending the end of the metal housing and is able to accommodate solder to butt connect an electronic component by soldering.

12. The electrical connector according to claim 1, wherein the insulating main body has a main body which is provided with a plurality of terminal accommodating recesses to accommodate the electrical terminals.

13. The electrical connector according to claim 12, wherein the main body opposite to the through spaces is provided with two accommodating recesses.

14. The electrical connector according to claim 7, wherein the metal housing is further provided with a retaining portion formed by downwards bending, extending, and further bending the end of the upper flat base portion and the retaining portion is further provided with a solder accommodating hole to accommodate solder.

15. The electrical connector according to claim 7, wherein each elastic piece, which is formed by stamping and upwardly extending the lower flat base portion, comprises an elastic piece base portion and a contact portion, in which the elastic piece base portion elastically supports the insulating main body and the contact portion abuts against the external electronic component inserted into the electrical connector through the through slot of the insulating main body.

16. The electrical connector according to claim 12, wherein the electrical terminal further comprises a soldering portion, a securing portion, and pressing portion, in which the soldering portion protrudes out of the insulating main body to butt connect with a base portion plate, the securing portion fastens and secures the electrical terminal into one of the terminal accommodating recesses, and the pressing portion is formed with resilience by extending and bending from the retaining portion so as to contact with the electrical terminal of the external electronic component inserted to achieve electrical conduction.

* * * * *